US012767411B2

(12) United States Patent
Balkau et al.

(10) Patent No.: US 12,767,411 B2
(45) Date of Patent: Oct. 20, 2026

(54) VALVE, AND PACKAGE

(71) Applicant: B&T ENTWICKLUNGS-UND VERMARKTUNGSGESELLSCHAFT MBH, Hamburg (DE)

(72) Inventors: Werner Balkau, Glarus-Süd / Schwändi (CH); Kurt Kronawittleithner, Horgen (CH)

(73) Assignee: B&T ENTWICKLUNGS- UND VERMARKTUNGSGESELLSCHAFT MBH, Hamburg (DE)

( * ) Notice: Subject to any disclaimer, the term of this patent is extended or adjusted under 35 U.S.C. 154(b) by 77 days.

(21) Appl. No.: 18/854,112

(22) PCT Filed: Apr. 5, 2023

(86) PCT No.: PCT/EP2023/058972
§ 371 (c)(1),
(2) Date: Oct. 4, 2024

(87) PCT Pub. No.: WO2023/194453
PCT Pub. Date: Oct. 12, 2023

(65) Prior Publication Data

US 2025/0229966 A1 Jul. 17, 2025

(30) Foreign Application Priority Data

Apr. 8, 2022 (EP) ..... 22167473

(51) Int. Cl.
*B65D 77/22* (2006.01)
*B65D 51/16* (2006.01)
(Continued)

(52) U.S. Cl.
CPC ..... *B65D 77/225* (2013.01); *B65D 65/46* (2013.01); *B65D 33/01* (2013.01);
(Continued)

(58) Field of Classification Search
CPC .. B65D 5/4295; B65D 33/01; B65D 51/1644; B65D 65/46; B65D 77/225;
(Continued)

(56) References Cited

U.S. PATENT DOCUMENTS 3,572,377 A * 3/1971 Graham ..... F16K 15/023 137/533.19
4,420,015 A * 12/1983 Blaser ..... B65D 77/225 220/203.18

(Continued)

FOREIGN PATENT DOCUMENTS

| | | |
|---|---|---|
| EP | 1 213 228 A1 | 6/2002 |
| GB | 2 091 388 A | 7/1982 |
| WO | 2021/186407 A1 | 9/2021 |

OTHER PUBLICATIONS

International Search Report dated Sep. 27, 2023, Application No. PCT/EP2023/058972; 2 pages.

*Primary Examiner* — Gideon R Weinerth
(74) *Attorney, Agent, or Firm* — Rankin, Hill & Clark LLP

(57) ABSTRACT

A pressure-relief valve includes a cup shaped main body with a bottom and a circumferential wall to be fastened to a flexible package material. The bottom has at least one through hole forming a passage through the main body. A valve membrane lies against the main body on a package side in a region around the through hole(s), with a sealing liquid between the main body and the valve membrane. The valve membrane thereby covers the at least one through hole. On the package side, the bottom has a system of grease grooves for accommodating a portion of the sealing liquid, the system of grease grooves comprising at least one outer grease groove having a main portion running in a circum-
(Continued)

ferential direction and having a radial extension extending from the main portion into a radial direction.

14 Claims, 2 Drawing Sheets

(51) Int. Cl.
*B65D 65/46* (2006.01)
*B65D 90/34* (2006.01)
*B65D 33/01* (2006.01)

(52) U.S. Cl.
CPC ..... *B65D 51/1644* (2013.01); *B65D 2205/00* (2013.01); *Y10T 137/7879* (2015.04)

(58) Field of Classification Search
CPC ..... B65D 2205/00; B65D 31/14; B65D 2205/02; F16K 24/04; F16K 15/023; F16K 15/144; F16K 15/162; F16K 17/0453; F16K 17/02; F16K 17/0493; F16K 17/164; F16K 17/205; F16K 2200/40; Y10T 137/4358; Y10T 137/7887; Y10T 137/7879
USPC ..... 220/89.1; 383/100–103
See application file for complete search history.

(56) References Cited

U.S. PATENT DOCUMENTS 4,444,219 A * 4/1984 Hollenstein ..... F16K 17/205 137/856
5,354,133 A * 10/1994 Rapparini ..... F16K 17/0453 383/103
5,992,442 A * 11/1999 Urquhart ..... B65D 77/225 137/533.19
6,056,439 A * 5/2000 Graham ..... B65D 77/225 383/103
11,352,183 B2 * 6/2022 Hoffman ..... F16K 15/144
2004/0000336 A1 * 1/2004 Goglio ..... F16K 15/141 137/247.15
2008/0011751 A1 * 1/2008 Stotkiewitz ..... B65D 77/225 220/203.1
2009/0289073 A1 * 11/2009 Moore ..... B65D 77/225 220/745
2010/0282768 A1 * 11/2010 Rapparini ..... B65D 77/225 220/745
2012/0048853 A1 * 3/2012 Stadel ..... B65D 77/225 220/89.1
2015/0284156 A1 * 10/2015 Helmer ..... B65D 51/1616 220/203.18
2019/0023454 A1 1/2019 Chen
2020/0239213 A1 * 7/2020 Stadel ..... B65D 77/225
2021/0188514 A1 6/2021 Beer
2021/0276780 A1 * 9/2021 Hoffman ..... B65D 77/225
2023/0148104 A1 * 5/2023 Rapparini ..... B65D 77/225 383/100
2025/0229966 A1 * 7/2025 Balkau ..... B65D 77/225

* cited by examiner

VALVE, AND PACKAGE

BACKGROUND OF THE INVENTION

Field of the Invention

The present invention is in the field of pressure relief valves for food packages.

Description of Related Art

Certain food products, for example fresh roasted coffee beans or coffee powder, have a tendency of degassing for some time. Therefore, food packages, for example coffee bags (coffee pouches) have a pressure relief valve. Pressure relief valves allow the gases—for example carbon dioxide—generated in the interior of the package to escape while preventing the surrounding air to enter into the package so that no oxygen will get into the package and freshness is preserved.

Pressure relief valves usually have cup-shaped main body, wherein an edge of the circumferential wall of the main body is welded or glued to an inside of the package material. Both the bottom of the main body and the package have an opening. On the bottom of the main body lies a disc as valve membrane, with an oil, for example a silicone oil, serving as sealing liquid between the bottom and the disk. If there is an overpressure within the package, the gas communicating through the opening of the bottom lifts the disc, so that the gas can escape into the interior of the main body and from there through the package opening out of the package. When there is no overpressure within the package, the disc lying against the bottom of the main body ensures a leak-tight sealing.

Pressure relief valves of this kind are beneficial in that they make possible that fresh food is directly packaged to be delivered to the end customer, without any intermediate re-packaging being necessary. This, in addition to ensuring freshness for the customer, has also advantages in terms of ecology. However, the pressure relief valves add to the environmental footprint of the package.

The overpressure necessary inside the package to trigger the pressure relief valve depends on the geometry of the main body as well as the materials of the main body, the valve membrane and the sealing liquid. Also, the required pressure to trigger the valve may depend on the package on which it is used and its content. In accordance with the prior art, given a certain size of the valve and its component, the adhesion force was tuned by using sealing liquids of different compositions depending, on the desired adhesion and hence triggering pressure. However, it is a challenge to fine tune adhesion forces by changing the chemical composition. Experiments will be required to do so. In particular, it is a challenge to tune the adhesion forces without making compromises in terms of other properties—especially if the materials of the valve membrane and of the main body are chosen in view of other properties and if there is no degree of freedom in adapting those.

SUMMARY OF THE INVENTION

It is therefore an object of the present invention to overcome disadvantages of prior art pressure relief valves. It is especially an object of the present invention to provide a way to set the adhesion force. It is another object of the present invention to provide a pressure relief valve that has a structure that makes it suitable for being made of eco-friendly material.

According to an aspect of the present invention, a pressure-relief valve is provided, the valve including a cup shaped main body with a bottom and a circumferential wall that is fastened to a flexible package material. The bottom has at least one through hole forming a passage through the main body. A valve membrane lies against the main body on a package side (in the cup constituted by the main body) in a region around the through hole(s), with a sealing liquid between the main body and the valve membrane. The valve membrane thereby covers the at least one through hole. On the package side, the bottom has a system of grease grooves for accommodating a portion of the sealing liquid, the system of grease grooves including at least one outer grease groove having a main portion running in a circumferential direction and having a radial extension extending from the main portion into a radial direction.

The side of the bottom opposite to the package side is called "product side" in this text.

An outer grease groove in this is a groove in the bottom located at a radially outer position, meaning that it is arranged at a radial distance from the at least one through hole. Especially, the outer grease groove(s) may be closer to the circumferential wall than to the center of the bottom.

It is known in the art that the main body may include a grease groove on the package side of the bottom. Grease grooves are shallow indentations on the surface region of the main body against which the valve membrane lies. Grease grooves act to accommodate excess sealing liquid and act as a reservoir for it. They are beneficial and often necessary to ensure that the space between the valve membrane and the surface against which it lies is always evenly provided with the sealing liquid.

In accordance with the present embodiment, the grease groove(s) in addition to having this well-known function have a further function, namely to adjust the adhesion force.

In particular, the radial extension of the grease groove may act to effectively shorten the shortest path along the valve membrane between a volume communicating with the at least one through hole and any other hollow space. In this, the volume communicating with the at least one through hole may be constituted by the through hole(s) itself, or by a indentation/groove around the through hole(s), such as an inner grease groove. The next other hollow space is, in accordance with the approach described herein, the outer grease groove itself. The length of this path is one of the parameters defining the triggering pressure: the shorter this path is, the less adhesion force has to be overcome to lift the pressure relief valve for releasing the overpressure. The length of this shortest path, and therefore in embodiments the length of the extension itself, may thus be used to set the adhesion.

By this approach, two problems are solved simultaneously.

Firstly, when the triggering force needs to be varied from application to application, it is sufficient to adjust the length of the radial extension. The approach with a radial extension thus makes possible that standard size of the main body and the valve membrane and a sealing liquid with a comparably high tendency to adhere are used for all packages. Due to the extension, the effective length of a path along which the valve membrane adheres to the main body surface is reduced. Thereby, the adhesion to be overcome by a pressure rise in the package until the valve is actuated is reduced also, the reduction of the adhesion force to be overcome being the greater the greater the size of the radial extension. Thus, in order to adapt the valve for different applications, demanding different actuation pressures/triggering pressures, only one parameter, namely the size (radial dimension) of the radial extension needs to be changed. This is one single geometrical parameter, and the effect is well predictable.

Secondly, this set-up makes possible that for different kinds of materials the valve membrane and the surface against which it lies are plane. In accordance with the prior art, sometimes set-ups with curved membranes were necessary so that the adhesion does not become too strong, whereby the elasticity of the membrane to some extent counter-acts the adhesion forces. This, however, has the disadvantage that if properties of the valve membrane material change, for example due to ageing or the taking up of moisture, so will the characteristics of the pressure relief valve. Especially, the eco-friendly bio-degradable materials have this tendency. The approach according to the present invention ensures that due to the extension, the effective length of a path along which the valve membrane adheres to the main body surface is reduced. In this way, it provides a way to overcome disadvantages of the prior art so that eco-friendly materials may be used as valve materials.

The approach with a radial extension makes possible that standard size of the main body and the valve membrane and a sealing liquid with a comparably high tendency to adhere are used for all packages.

In embodiments, the radial extension, or at least one of the radial extensions, is a radial inward extension.

In these embodiments, a shortest path along the valve membrane between a volume communicating with the at least one through hole and any other hollow space may lead from the volume communicating with the at least one through hole to an innermost point of the inward extension—if the radial inward extension extends to closer to the volume communicating with the hole(s) than any other structure.

In a group of embodiments, the main body includes a plurality of outer grease grooves. For example, the outer grease grooves may include a circular array of at least two outer grease grooves together forming an (interrupted) ring.

Especially, the outer grease grooves may include a circular array of first outer grease grooves and a circular array of second outer grease grooves, the first outer grease grooves being arranged around the second outer grease grooves. In such a configuration, the second outer grease grooves may be staggered with respect to the first outer grease grooves, so that the second outer grease grooves cover gaps between first outer grease grooves, whereby there is no radial line from a center of the bottom to its periphery (to the circumferential wall) that would not be interrupted by an outer grease groove.

In embodiments in which the outer grease grooves are provided in at least one circular array, one inward extension may be present per grease groove. If there are several circular arrays, an inward extension per grease groove of one of the arrays may be sufficient.

In embodiments with two circular arrays of grease grooves, the radial inward extension(s) may be inward extension(s) of the first outer grease grooves. They may extend through gaps between second outer grease grooves optionally to positions radially inwardly of the positions of the second outer grease grooves.

In addition to the above-described function of regulating the adhesion force, the radial extensions thereby balance the distribution of the sealing liquid between the first and second outer grease grooves.

In embodiments with two circular arrays of grease grooves, the second outer grease grooves may include radial outward extensions extending outwardly into the spaces between the first outer grease grooves. Thereby, the distribution of the sealing liquid between the grease grooves is further improved.

The system of grease grooves may, in addition to the outer grease groove(s), also include an inner grease groove extending around the at least one through hole. The outer grease groove(s) may be deeper than the inner grease groove (if any).

The main body on the inside of the circumferential wall in the plane defined by the valve membrane may include an extension accommodating groove. The extension accommodating groove provides a space into which the valve membrane can expand so that it does not bulge upon an expansion, for example if it takes up moisture.

The surface portion of the main body against which the valve membrane lies may be flat as opposed to curved (vaulted) surface portions of prior art valves. Such a flat structure may be beneficial especially if the valve membrane and/or the main body is/are made of bio-degradable material, since then the adhesion force does not alter when properties such as the material elasticity slightly change because of the take-up of moisture or because of ageing. The flat structure is especially beneficial together with the extension accommodating groove because the combination allows a precise placement of the valve membrane—by adapting the diameter to the inner diameter of the cup-shaped main body—without entailing the risk of the membrane becoming vaulted or otherwise deformed when expanding.

In embodiments, if the package is to contain a finely grained product such as coffee powder (ground coffee), the valve further includes a permeable membrane, which is attached to the product side of the bottom covering the at least one through hole so as to prevent the product from clogging the through opening while being permeable for gases. The permeable membrane may be a fabric membrane. In this text, "fabric" is used to cover all kinds of flexible materials from fibers or yarns or threads that are interlocked, including nonwovens, woven or knitted textiles or other textile structures.

In a group of embodiments, especially if the valve has a permeable membrane, the main body has at least one indentation on the product-side, thus forming an indented portion. The at least one through hole—or at least one of the through holes—has its product-side mouth in the indented portion. Thereby, the mouth of the through hole(s) on the product side is offset with respect to a product-side outermost plane. This means that if a permeable membrane is present, the mouth of the through hole(s) is offset with respect to a plane of the permeable membrane. The indented portion can effectively constitute a system of ventilation grooves, with spacers between them.

In embodiments, the spacers have rounded edges. Therefore, there is less risk of damaging the permeable membrane when the package is subject to mechanical stress.

In embodiments, the valve further includes a fixing part. The fixing part is shaped to be placed on the package side of the valve membrane. It prevents the valve membrane from falling out of the main body even in situations in which the valve is subject to substantial mechanical shock. The valve may especially be subject to such shock, during transportation and assembly processes, if it is provided as a bulk material. In a situation of mechanical shock, the fixing part keeps the valve membrane in place even if adhesion by the sealing liquid might not be sufficient to do so. The fixing part may be held relative to the main body by the circumferential wall of the main body forming an undercut, so that the fixing part is clickable into the main body.

In embodiments, the valve may be bio-degradable, i.e., all components may be made of bio-degradable material. As mentioned hereinbefore, the structure of the grease grooves makes the valve especially suitable for valve membranes of bio-degradable materials and/or main bodies of bio-degradable material. In embodiments, also optional other components are bio-degradable.

In the present text, "bio-degradable" may mean biologically degradable according to the European standard EN 13432 (as of the end of 2021). In addition or as an alternative, it may mean biologically degradable according to the European standard EN 14995 (as of the end of 2021). Thus "bio-degradable" especially refers to "biologically degradable according to EN 13432 and/or according to EN 14995.

As far as in the present text water-soluble polymers are mentioned, such water soluble polymer may optionally be degradable in sewage treatment plants (aerobic biodegradability) in accordance with DIN EN ISO 9888 (as of the end of 2021); determined in accordance with the so-called Zahn-Wellens test.

Especially, at least one component, for example the main body, of the valve may be made of a polymer composition including a water-soluble polymer. In embodiments, the polymer composition further includes a salt, especially a hygroscopic salt.

In addition to including a water-soluble polymer and a salt, the composition may include a plasticizer. The plasticizer may be selected from the group consisting of polyols (oligo-and polyhydroxy compounds) and low molecular weight amides In embodiments, the main body and, if present the permeable membrane and the fixing part each are of a polymer composition that includes a polyvinyl alcohol (PVOH) as a water-soluble polymer, a salt, and glycerin as a plasticizer.

In embodiments, the valve membrane is of a polymer composition that is not water-soluble but bio-degradable, for example of Polyhydroxybutyrate (PHB).

In addition to concerning a pressure relief valve, the invention also concerns a package, especially a coffee pouch for coffee beans or ground coffee. The package includes flexible, pliant packaging material as well as a pressure relief valve as described in the present text. The main body of the pressure relief valve is attached to the packaging material. Especially, the annular end face of the pressure relief valve may be attached to the packaging material, with the valve membrane (and if present the fixing part) being arranged in the hollow space between the bottom of the main body and the packaging material. The packaging material is generally gas-tight but has an opening or other permeable structure at a position encompassed by the circumferential wall of the main body.

BRIEF DESCRIPTION OF THE DRAWINGS

Hereinafter, embodiments of the present invention are described with reference to drawings. In the drawings, same number designate same or corresponding elements. The drawings show.

DETAILED DESCRIPTION OF THE INVENTION

Figure 2:
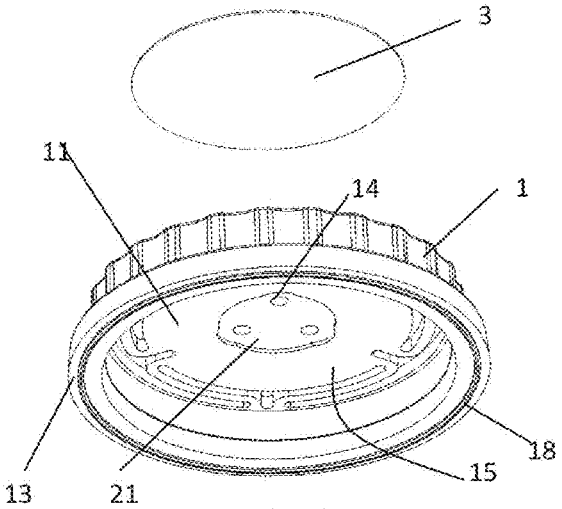
FIG. 2 a main body in a view.
Figure 2:
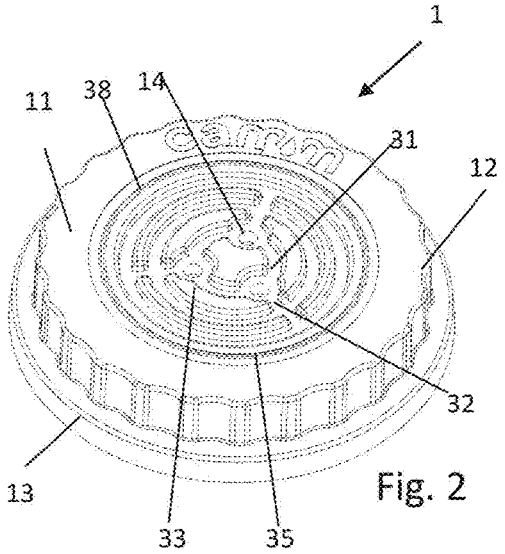
Figure 1:
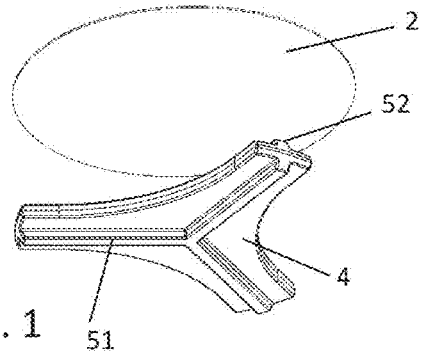
FIG. 1 An exploded view of the components of a pressure relief valve.
Figure 3:
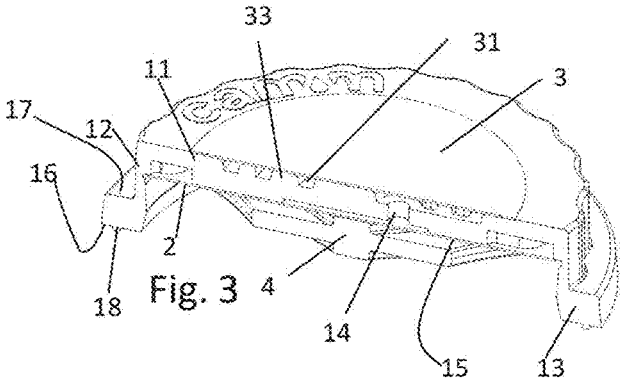
FIG. 3 a view of the cut assembled valve.
Figure 4:
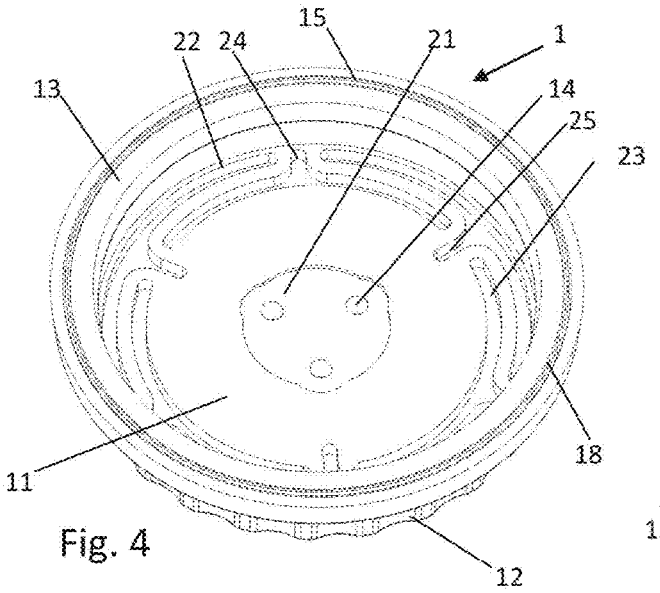
FIG. 4 the main body in a different view.
Figure 5:
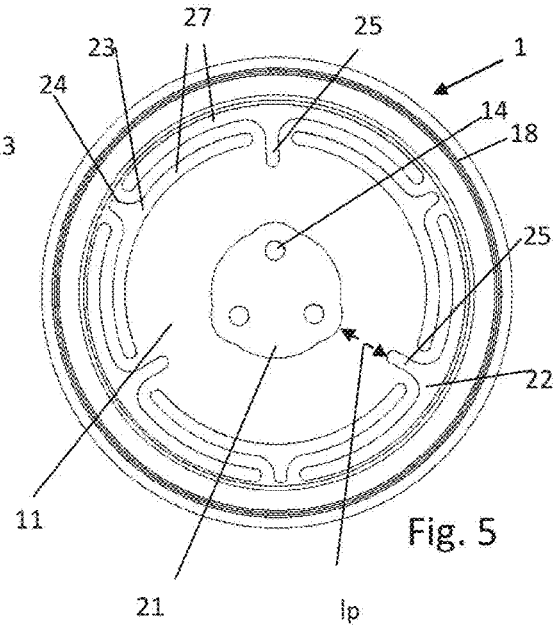
FIG. 5 yet a further view of the main body.
Figure 6:
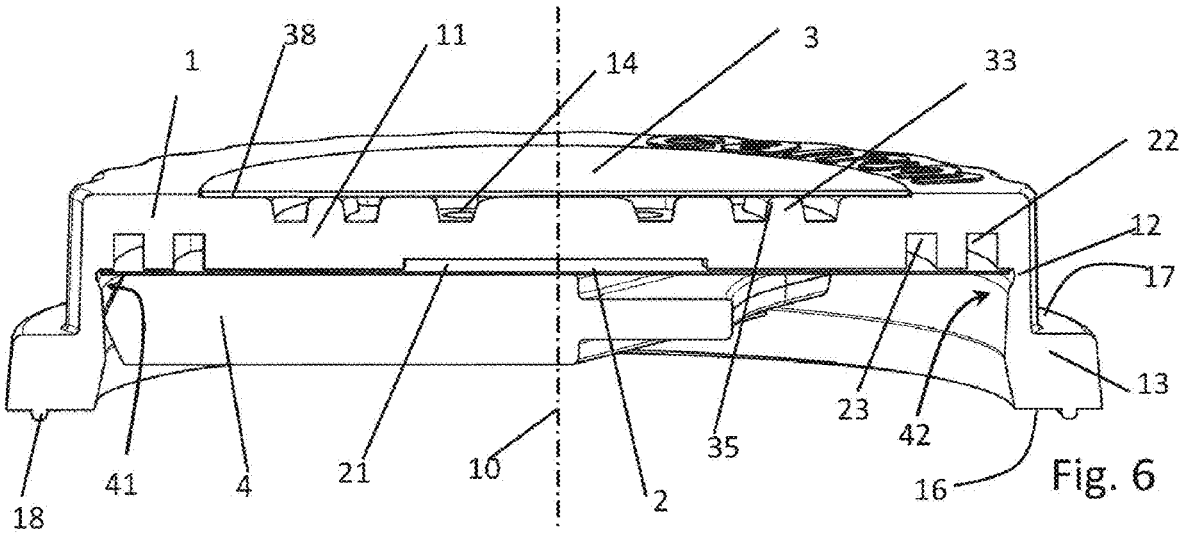
FIG. 6 a further view of the cut assembled valve.

The pressure relief valve shown in FIGS. 1, 3 and 6 includes a main body 1 that is also shown in FIGS. 2, 4 and 5. The main body 1 has an overall shape of a flat cup, with a bottom 11 and a circumferential wall 12. The bottom 11 has a sealing surface and, opposite the sealing surface, a product-side surface.

The circumferential wall 12 surrounds the sealing surface of the bottom 11 and has, at its end opposite the bottom 11, a flange 13, i.e. an outwardly protruding collar, so that the annular end face 16 that carries a package-side energy directing rib 18 is broader. The bottom has at least one through hole 14—in the depicted embodiment there are three through holes 14—that is covered by the valve membrane 2 lying against the bottom 11 on the sealing surface thereof. Between the bottom 11 and the valve membrane 2 there is a thin layer of a sealing liquid, especially an oil, for example a silicone oil. Silicone oils are known for this purpose. Hence, the sealing liquid is not described in any more detail in the present text.

The pressure relief valve for use is placed inside of a gastight flexible package in that the annular end face of the circumferential wall 11 is bonded to the package inner surface, for example by welding. The package material has at least one gas passage (for example at least one small through hole or a permeable section) at a place surrounded by the annular end face. If there is an overpressure inside the package, the gas will cause the valve membrane 2 to be lifted from the bottom 12, whereby a gas passage is created. Excess gas can then escape through the through hole(s) 14, between the valve membrane and the bottom and through the gas passage of the package. When there is no overpressure inside the package, the membrane closes the package by lying against the bottom, with the sealing liquid adhering to the bottom and the valve membrane by capillary forces forming a seal.

The main body 1 on the inside of the circumferential wall 12 and in the plane defined by the valve membrane 2 includes an extension accommodating groove 41. It has been found that such groove 41 is beneficial for the following reason: The valve membrane 2 may be of a bio-degradable polymer composition. It has been found that in contrast to prior art valve membrane materials, these materials may have a tendency to be subject to changes in the dimension depending on the environmental conditions. For example, they may slightly expand if subject to moisture.

In embodiments, the pressure relief valve has a permeable membrane 3 in addition to the main body 1 and the valve membrane 2. In contrast to the valve membrane 2, the permeable membrane 3 is gas permeable. It may for example be a fabric, such as a nonwoven fabric. The permeable membrane is attached to the product-side surface of the bottom and covers at least the through opening(s) 14. The permeable membrane is useful if the package contains a finely grained product, especially ground coffee in that it prevents the product from clogging the opening(s) and from getting into contact with the sealing liquid and the valve membrane 2. It is not necessary for packages containing for example coffee beans or other coarse products.

The permeable membrane 3 may be of a polymer material, for example by being a fabric of thermoplastic fibers. It may in embodiments be welded to the main body. To this end, the main body has a product-side energy directing rib 38 on the side facing the packaged product.

In the side of the sealing surface, the main body has a plurality of grease grooves. More in concrete the main body has an inner grease groove 21 surrounding the opening and moreover has a ring of three first outer grease grooves 22 and a ring of three second outer grease grooves 23, the first outer grease grooves 23 being arranged around the second outer grease grooves 22. The outer grease grooves 22, 23 generally run in a circumferential direction, each having a main portion 27 extending circumferentially, parallel to the circumferential wall. The second outer grease grooves 23 each have an outward extension 24 extending radially outwardly from the main portion 27 into the gaps between the first outer grease grooves 22. The first outer grease grooves 22 each have an inward extension 25 extending radially inwardly from the main portion 27 into the gaps between the second outer grease grooves 23 and even extending to further radially inwardly.

In the present text, "radial" as well as "outward" or "inward" or "circumferential" are meant to refer to an axis 10 of the main body; the presence of a central axis does not necessarily imply an axial symmetry, though such symmetry with is an option.

The outer grease grooves have the function of serving as a reservoir for the sealing liquid. To this end, they are located at a radial position so as to be covered by the valve membrane (see for example FIG. 3 or FIG. 6). For example when the valve is, for example during transportation of the valve prior to the bonding to the package or during transportation of the package with the valve, subject to temporary mechanical loads, it may be that sealing liquid is forced out from between the bottom 11 and the valve membrane 2. The grease groove ensures that thereafter capillary forces can draw sealing liquid from the grease grooves underneath the valve membrane again. Similar considerations apply to the manufacturing process: because of the grease grooves, it is sufficient that a drop of sealing liquid is dispensed onto the bottom or the membrane, and the grease grooves ensure that the sealing liquid is well distributed and the sealing membrane uniformly adheres to the bottom all around the through holes 14.

In addition to having this well-known function, the special structure of the outer grease grooves 22, 23 makes possible a better control of the adhesion forces. Namely, the distance between the inner grease groove 21 and the outer grease grooves 22, 23 defines the minimal length pi of a path along which the adhesion force has to be overcome to trigger the valve by lifting the valve membrane 2 from the bottom 11. If no inner grease groove would be present, the quantity of interest would be the distance between the through hole(s) 14 and the inward extension 25.

As is illustrated in FIG. 5, this path length lp may be controlled by choosing the length of the inward extensions 25.

Both, the outward extensions 24 and the inward extensions 25 have the further function of distributing the sealing liquid between the grease grooves. For example, because of the outward extensions 24 and the inward extensions 25, sealing liquid may communicate between the first and second outer grease grooves and between different first grease grooves and different second grease grooves.

The system including a circular array of at least two (three in the depicted embodiment) first outer grease grooves 22 and/or a circular array of at least two (three in the depicted embodiment) second outer grease grooves 23 nevertheless features the advantage, over an arrangement in which the grease groove would be an uninterrupted ring, that the sealing liquid is well distributed along the periphery of the bottom 11 even in situations in which the valve is kept in an unchanged a vertical orientation for a long time.

In embodiments, the pressure relief valve in addition to the main body 1 and the valve membrane 2, and, as the case may be, to the permeable membrane 2 has a fixing part 4. The fixing part 4 is optional and may serve as a spacer between the flexible package material and the valve membrane 2, making sure that the valve membrane 2 cannot be displaced even in events of severe mechanical concussion. In the depicted embodiment, the fixing part 4 is star shaped with three rays. The it has a distance keeping first rib 51 and a distance keeping second rib 52. The overall star shape and the distance keeping ribs 51, 52 constitute a material saving shape nevertheless having a stable orientation. Also, the star shape ensures some elasticity of the fixing part 4.

As can be seen for example in FIG. 6, the shape of the circumferential wall 12 forms a slight undercut 42 on the inside, with the inner surface of the main body being slightly conical. Due to this undercut shape, the fixing part 4 can be clicked into the main body and due to its elasticity remains there.

On the product facing side, the main body 1 is structured to include a system of ventilation grooves 31 and spacers 33. The system is such that the through holes 14 are on a bottom of a ventilation groove, i.e., at a position where the product-side surface is indented. Radial channels 32 that belong to the system of ventilation grooves 31 ensure that the gases diffusing through the permeable membrane into the ventilation channels can get to the through holes 14. Thereby, the gases encounter less resistance and can diffuse through a comparably large surface portion in that the membrane is not pressed, by overpressure within the package, against a flat surface. Rather, the spacers 33 keep it away from the plane in which the through holes 14 have their mouths.

A further effect of the system of ventilation grooves is that the permeable membrane 3 is prevented from sticking to the main body in a region around the through holes 14. Such sticking could occur for example during the process of bonding the permeable membrane 3 to the main body by ultrasonic welding.

As is illustrated for example, in FIG. 6, the spacers 33 have rounded edges 35 so that there is less risk of damaging the permeable membrane when the package is subject to mechanical stress.

The overall shape of the main body with the flange 13 and the broadened end face 16 (that is bonded to the package material) yields a further improvement, relating to the process of bonding the valve to the package material and to the stability of the bond. Namely, the shoulder that is defined by the flange being an outwardly protruding collar yields a coupling face 17 on which a tool for bonding the valve to the package material can directly act. Thereby, the energy—usually ultrasonic energy—coupled by the tool into the main body 1 for the bonding process does not need to be coupled through the entire height (axial extension) of the main body but only across the thickness of the flange 13. This makes the bonding process more efficient compared to a situation in which the tool would press against the product-side end face of the main body.

The tool may for example be a tube shaped sonotrode, with a tube diameter approximately corresponding to the diameter of the flange 13.

However, the flange 13 and the broadened end face 16, are just optional. In alternative embodiments, the main body 1 does not have this structure. The main body 1 also in these alternative embodiments is weldable to the package material in that a sonotrode impinges on the product-side end face of the main body. Also in these embodiments, the used sonotrode may optionally be tube shaped, with a tube diameter being greater than an outer diameter of the region that has the system of ventilation grooves and spacers. However, alternatively, the sonotrode then may have a flat outcoupling face.

In the depicted embodiment, the main body 1, the fixing part 4 and the permeable membrane 3 are all made of polymer compositions including a salt in addition to including a water-soluble polymer:

The main body 1 and the fixing part 4 are injection molded from a polymer composition including PVOH obtained e.g. by the saponification of Poly(vinyl ester), a salt (especially sodium chloride), and glycerine. The polymer compositions of the main body and the fixing part may be identical.

The permeable membrane is a textile of fibers of a polymer composition also including PVOH obtained e.g. by the saponification of Poly(vinyl ester), a salt (especially sodium chloride), and glycerine.

The valve membrane 2 is made of PHB.

All components are thus bio-degradable.

Figure 7:
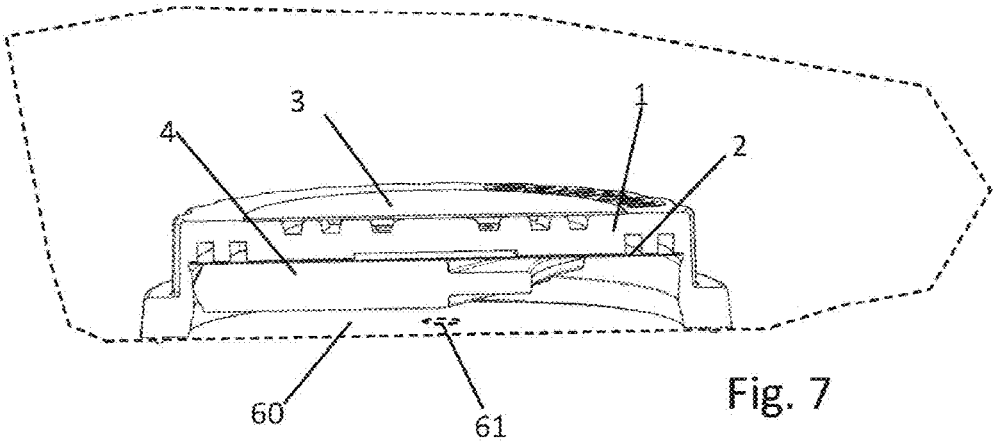
FIG. 7 schematically, the valve in a package.

FIG. 7 schematically shows a package with the valve. The main body 1 is welded to the packaging material 60. The packaging material has a through hole 61 for the gases to be released.

What is claimed is:

1. A pressure-relief valve, the valve comprising a cup shaped main body having a bottom and a circumferential wall, said cup shaped main body configured to be fastened to a flexible package material;

the bottom having at least one through hole forming a passage through the main body;

a valve membrane lying against the main body on a package side in a region around the at least one through hole; and a sealing liquid disposed between the main body and the valve membrane; wherein the bottom, on the package side, has a system of grease grooves for accommodating a portion of the sealing liquid;

the system of grease grooves comprising at least one outer grease groove having a main portion running in a circumferential direction and having a radial extension extending from the main portion in a radial direction.

2. The pressure-relief valve according to claim 1, wherein the system of grease grooves comprises at least one circular array of at least two first outer grease grooves.

3. The pressure-relief valve according to claim 2, wherein the system of grease grooves further comprises at least one circular array of at least two second outer grease grooves, the first outer grease grooves being arranged around the second outer grease grooves, and the second outer grease grooves being staggered with respect to the first outer grease grooves.

4. The pressure-relief valve according to claim 3, where at least one of the first outer grease grooves has a radial extension being an inward extension extending inwardly between the second outer grease grooves.

5. The pressure-relief valve according to claim 3, wherein at least one of the second outer grease grooves has a radial extension being an outward extension extending outwardly between the first outer grease grooves.

6. The pressure-relief valve according to claim 1, wherein the system of grease grooves further comprises an inner grease groove extending around the at least one through hole.

7. The pressure-relief valve according to claim 6, wherein the at least one outer grease groove is deeper than the inner grease groove.

8. The pressure-relief valve according to claim 1, wherein the radial extension or at least one of the radial extensions is an inward extension, and wherein, when the valve membrane lies against the main body, a shortest path along the valve membrane between a volume communicating with the at least one through hole and any other hollow space leads from said volume communicating with the at least one through hole to an innermost point of the inward extension.

9. The pressure-relief valve according to claim 1, wherein at least one component of the pressure-relief valve is made of a polymer composition comprising a water-soluble polymer.

10. The pressure-relief valve according to claim 1, being bio-degradable.

11. The pressure-relief valve according to claim 1, further comprising a permeable membrane being a fabric secured to the main body to cover the at least one through hole on a product side opposite the package side.

12. The pressure-relief valve according to claim 1, wherein the main body has a system of ventilation grooves, with spacers between them, the mouth of the through hole or the at least one of the through holes being in a ventilation groove.

13. The pressure-relief valve according to claim 1, further comprising a fixing part fixed relative to the circumferential wall so that the valve membrane is sandwiched between the bottom and the fixing part.

14. A package for packaging food products, the package comprising a flexible, pliant packaging material as well as the pressure-relief valve according to claim 1, wherein the main body is attached to the packaging material.

* * * * *